United States Patent [19]

Burkhardt

[11] 4,026,404

[45] May 31, 1977

[54] APPARATUS FOR THE BODILY SHIFTING OF A PRINTING ROLLER

[76] Inventor: Gottfried Burkhardt, Am Bahndamm 264, 8501 Winkelhaid, Germany

[22] Filed: Nov. 13, 1975

[21] Appl. No.: 631,636

[30] Foreign Application Priority Data

Nov. 15, 1974 Germany ..... 2454218

[52] U.S. Cl. ..... 197/73; 197/144

[51] Int. Cl.[2] ..... B41J 11/14

[58] Field of Search ..... 101/93.41, 93.42; 197/16, 18, 53, 55, 71–73, 144

[56] References Cited

UNITED STATES PATENTS

| | | | |
|---|---|---|---|
| 929,896 | 8/1909 | Tanner et al. | 197/73 |
| 1,044,331 | 11/1912 | Young | 197/73 |
| 1,750,363 | 3/1930 | Schmid | 197/60 |
| 1,917,984 | 7/1933 | Kittel | 197/73 |
| 1,929,064 | 10/1933 | Hart | 197/73 |
| 2,233,949 | 3/1941 | Kurowski | 197/73 X |
| 3,174,609 | 3/1965 | Frechette et al. | 197/73 |
| 3,910,398 | 10/1975 | Kubota et al. | 197/73 |
| 3,934,697 | 1/1976 | Kuramochi | 197/72 |

*Primary Examiner*—Edgar S. Burr
*Assistant Examiner*—Paul T. Sewell

[57] ABSTRACT

An apparatus for the bodily shifting of a printing roller in parallelism with itself in which the roller has a first printing position and a second printing position and is mounted on connecting rods or levers which are actuated by eccentrics for movement of the printing roller between its first and second positions. A drive shaft is provided and the eccentrics are driveable by the drive shaft by a coil spring surrounding the drive shaft which can be tightened up on the shaft to cause the shaft to drive the spring or loosened on the shaft to cause the shaft to rotate within the spring. The spring has its opposite ends connected to discs and is tensioned in the tightening up direction and the discs are adapted to be stopped by a pawl arrangement which holds the discs with the spring in loosened up position and is movable to release the discs of the spring and will tighten up on the shaft and be driven thereby.

4 Claims, 4 Drawing Figures

APPARATUS FOR THE BODILY SHIFTING OF A PRINTING ROLLER

With mechanical high output printers, it is known for purposes of mounting the types in a space-saving manner to arrange the types on a printing knob at two levels.

It is an object of the present invention to provide a lifting device for printing rollers which will be able to lift a printing roller or printing strip from a first level into a second level for type printing.

It is another object of this invention to provide a lifting device for lifting printing rollers which will make it possible to lift the printing roller between a printing interval of two types and subsequently to lower the printing roller.

It is still another object of this invention to provide a lifting device as set forth in the preceding paragraphs which will permit a precise equal line printing of the types at the various levels.

These objects and other objects and advantages of the invention will appear more clearly from the following specification in connection with the accompanying drawings, in which.

Figure 1:
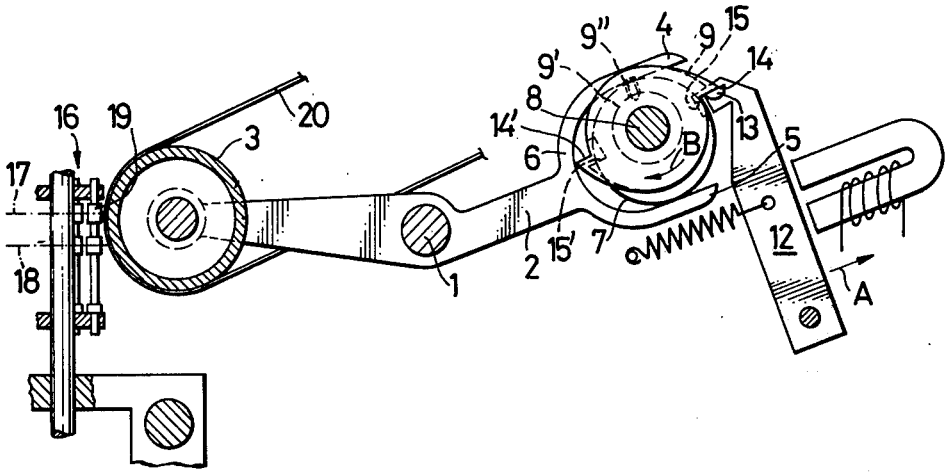
FIG. 1 illustrates a lifting device for a printing roller according to the invention.

The lifting device for printing rollers according to the invention for a one-line printing of types arranged at two levels, according to which the printing rollers is adapted to be lifted and lowered by means of a cam controlled lever is characterized primarily in that one of the pivotal levers mounting the printing roller rests through the intervention of a fork on an eccentric disc which latter through the intervention of a coupling is adapted to be rotated.

Referring now to the drawings in detail, a pivotal lever 2 is journalled on a pivot 1 which is fixedly arranged in a frame not shown. This lever has mounted thereon on one hand a printing roller 3 while on the other hand it has its legs 4, 5 pertaining to a U-shaped fork 6 in engagement with a eccentric disc 7. One a shaft 8 which is fixedly connected to a frame (not shown) there are arranged an eccentric disc 7 connected to an abutment region disc 9, and a coupling disc 11 connected to the abutment disc 9 by a compression spring 10 looped around shaft or pin 8.

The eccentric disc 7 is mounted on a hub 9' of the abutment region disc 9'' and through the intervention of a threaded pin 9' is adjustable relative to disc 9.

An electromagnetically operable pawl 12 comprises a lateral overhang pin 13. This pin 13 is adapted to engage a nose 14, 14' of the coupling disc 11. The pawl 12 in its turn engages a ratchet 15, 15' of the abutment region disc 9. Each disc has abutment regions for engagement with the pawl which are displaced 180 degrees from each other about the periphery of the discs. A type drum 16 of a roller printer is fixedly mounted in a frame (not shown) in front of the printing roller 3. This drum 16 comprises a plurality of shafts on which types 19 are respectively mounted at two levels 17, 18. A paper web 20 is passed over the printing roller 3.

In view of the brief withdrawal of the pawl 12 in the direction of the arrow A, the abutment region disc 9 is freed slightly in front of the coupling disc 11. Inasmuch as the spring 10 is preloaded in the direction of rotation B of the shaft, said spring 10 will in view of the continuously turning shaft 8 pull itself fast or taut onto the pin and thereby will take along the disc 9, 11 while the noses 14, 14' of the coupling disc 11 somewhat run ahead of the ratchets 15, 15' of the abutment region disc 9. The eccentric disc 7 is turned by 180° by means of the spring 10 acting as friction clutch until the pin 13 abuts the oppositely located nose 14' and thereby pivots the printing roller 3 from the lever 17 to the level 18.

At the instant to which the pin 13 abuts the nose 14', the ratchet 15' of the abutment disc is still spaced by a distance C from the pawl 12. This distance C is bridged by the swing or momentum of the abutment region disc 9 which is connected to the eccentric disc 7 so that the pawl 12 drops into the ratchet 15', and subsequently a type print can be effected.

During the bridging of the distance C, spring 10 is by means of the abutment region disc 9 turned in the direction counter to the direction of action of its preload whereby the spring 10 disengages shaft 8.

When again pulling back the pawl 12, the described operations will occur in the same manner whereby the condition shown in FIG. 1 will be restored.

A simultaneous printing of the types at the levels 17 and 18 is realized by a corresponding adjusting of the eccentric disc 7 relative to the abutment region disc 9 inasmuch as the threaded pin after adjustment connects the two discs 7, 9 firmly with each other.

Figure 4:
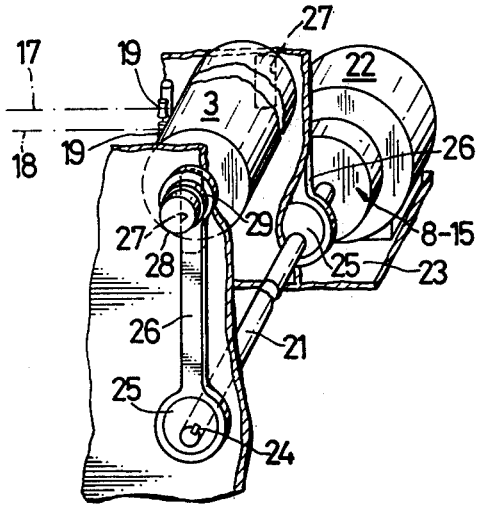
FIG. 4 shows a further lifting device for printing rollers.

In addition to the lifting device for the printing rollers illustrated in FIG. 1 by means of a pivotable lever 2, it is also possible according to FIG. 4 to employ a lifting device at both sides with a shaft 21 arranged at a lower level. For purposes of driving the shaft 21, the coupling 8–15 and an electric motor 22 are provided and are journalled in or connected to a frame 23. Connecting rod means 26 are mounted on two eccentric discs 25 which are keyed to shaft 21 by means of keys 24. The connecting rods 26 are connected to journals 28 of the printing roller 3 which journals are displaceable in oblong holes 27 on both sides of the frame 23. Rings 29 are provided for preventing accidental axial movement of the printing roller 3.

Figure 2:
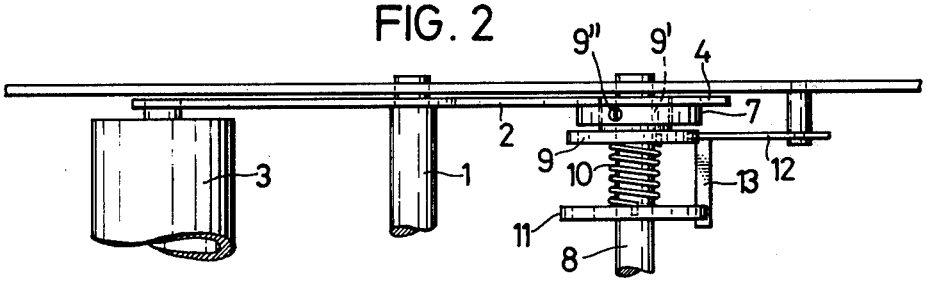
FIG. 2 shows the device of FIG. 1 as seen from above.
Figure 3:
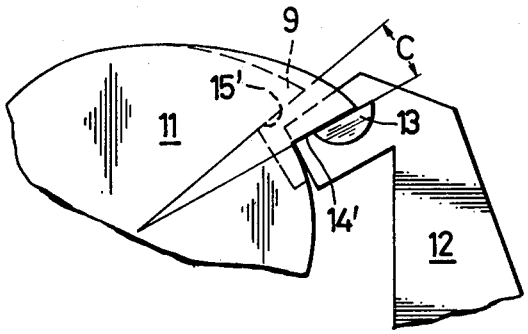
FIG. 3 represents a moving phase of the device of FIG. 1.

By means of motor 22 and the pawl 12 (not illustrated in FIG. 4), the eccentric discs 25 are turned by 180° in the same manner as described in connection with FIGS. 1–3. Due to the effected maximum stroke of the eccentric discs 25, the connecting rods 26 pull the printing roller 3 by means of the oblong holes 27 out of the level 17 into the level 18 so that the corresponding types 19 can be printed. In order subsequently to be able to print the types 19 located at the level 17, shaft 24 is in the described manner again turned by 180°.

Adjacent to the noses 14, 14' and ratches 15, 15' which are respectively arranged in opposite manner on the coupling disc 11 and abutment region disc 9 for an adjustment of the printing roller at two levels 17, 18, it is possible by a 90° arrangement of corresponding noses and ratchets also to provide a type arrangement at three levels and to cause the same to be printed.

It is, of course, to be understood that the present invention is, by no means, limited to the specific showing in the drawings, but also comprises any modifications within the scope of the appended claims.

What is claimed is:

1. An apparatus for moving a printing roller in parallelism with itself between a first printing position and a second printing position which comprises; lever means connected at one end to the roller, eccentric means engaging said lever means for actuation of the lever means and therethrough said printing roller, a driven shaft, and intermittently operable coupling means connecting said shaft to said eccentric means for effecting rotation of the eccentric means, said coupling means including a pair of axially spaced discs rotatable on said shaft, a coil spring having one end connected to each disc and surrounding said shaft and biased in a direction to tighten on said shaft when said discs are free on said shaft, said eccentric means being connected to one of said discs to rotate therewith, and pawl means engageable with said discs for holding said discs against rotation and in such relatively rotated position that said spring is loose on said shaft and said shaft is free to rotate in said spring.

2. An apparatus according to claim 1 in which said pawl means comprises means for engaging peripheral notches formed in said discs.

3. An apparatus according to claim 1 in which the eccentric means is angularly adjustable on said one disc by a pin engaging a hub.

4. An apparatus according to claim 1 in which each disc has abutment regions including noses and rachets for engagement of said pawl means which are displaced 180° from each other about the periphery of the discs, means pivotally supporting said pawl means for swinging movement thereof into and out of the path of said abutment regions, said abutment regions on the respective discs being angularly spaced from one another and stopping the discs with the spring released from the shaft, said pawl when actuated into disc release position permitting said spring to tighten on the shaft and establish driving engagement of the spring with the shaft.

* * * * *